US007075490B2

(12) United States Patent
Noro

(10) Patent No.: US 7,075,490 B2
(45) Date of Patent: Jul. 11, 2006

(54) ANTENNA DEVICE AND RADIO WAVE RECEIVING SYSTEM USING SUCH DEVICE

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 11 days.

(21) Appl. No.: 10/867,771

(22) Filed: Jun. 16, 2004

(65) Prior Publication Data

US 2005/0068236 A1 Mar. 31, 2005

(30) Foreign Application Priority Data

Sep. 29, 2003 (JP) ..... P. 2003-336727

(51) Int. Cl.
*H01Q 1/32* (2006.01)

(52) U.S. Cl. ..... 343/713; 343/700 MS

(58) Field of Classification Search ..... 343/700 MS, 343/702, 713, 841, 872
See application file for complete search history.

(56) References Cited

U.S. PATENT DOCUMENTS 4,728,962 A * 3/1988 Kitsuda et al. ..... 343/872
5,585,809 A * 12/1996 Yajima et al. ..... 343/713
5,706,015 A * 1/1998 Chen et al. ..... 343/700 MS
5,757,327 A * 5/1998 Yajima et al. ..... 343/713
6,023,245 A * 2/2000 Gomez et al. ..... 343/725
6,118,410 A * 9/2000 Nagy ..... 343/713
6,166,698 A * 12/2000 Turnbull et al. ..... 343/713
6,346,919 B1 * 2/2002 Wang et al. ..... 343/767

FOREIGN PATENT DOCUMENTS

JP 2003-198235 7/2003

* cited by examiner

*Primary Examiner*—Tan Ho
(74) *Attorney, Agent, or Firm*—Whitham, Curtis, Christofferson & Cook, PC

(57) ABSTRACT

An antenna device suitably provided in a vehicle is provided with low cost. A receiving module is fixed in the internal space formed by a pair of case parts. The receiving module includes a dielectric substrate, an antenna element provided on one main surface of the dielectric substrate, a ground plate provided on the other main surface of the dielectric substrate, and a circuit board provided on the backside of the main surface having the dielectric substrate at the ground plate, and a shield case that shields the circuit board. The ground plate has an extension extending parallel to the antenna element from the outer peripheries of said dielectric substrate and the circuit board, and the extension is supported in the pair of the case parts, so that the receiving module is fixed in the internal space of the pair of case parts.

9 Claims, 2 Drawing Sheets

ANTENNA DEVICE AND RADIO WAVE RECEIVING SYSTEM USING SUCH DEVICE

BACKGROUND OF THE INVENTION

1. Field of the Invention

The present invention relates to a satellite radio receiving antenna and a satellite radio wave receiving system for receiving satellite radio broadcasting, and more particularly, to a satellite radio receiving antenna suitably provided on the inner surface of a windowpane (in the interior) in a vehicle and a satellite radio receiving system using the satellite radio receiving antenna.

2. Description of the Related Art

In recent years, a satellite broadcasting system in which signals including audio and video information are transmitted from a broadcasting satellite for broadcasting has been in wide use. At present, in the United States of America, audio sound information provided by such a satellite broadcasting system, so-called satellite radio broadcasting is provided by XM Satellite Radio Inc. In the satellite radio broadcasting system, signals transmitted from a satellite can be received in a wide area on the earth, and therefore the broadcasting can be received and listened to not only in fixed locations such as in general households with a receiver, but also in a moving body (vehicle) such as an automobile with a receiver provided in the moving body. The latter case has attracted much attention (see Japanese Patent Laid-Open No. 2003-198235).

In a satellite radio receiving system, when a receiver is provided in a vehicle, the location of the receiving antenna is crucial. In the conventional satellite radio receiving system, the antenna is typically provided on the roof of the vehicle. However, when the antenna is provided on the exterior of the vehicle in this way, the receiving antenna must have water and weather resistance, which complicates the structure of the receiving antenna and pushes up the cost. When the antenna is provided on the exterior of the vehicle, a signal line must be extended from the receiving antenna to a receiver provided in the vehicle, and it is therefore troublesome and much costly to provide the satellite radio receiving system.

When such a receiving antenna is provided inside an automobile in order to solve the above described problem, the roof and pillars of the automobile that are typically made of a metal that obstructs signals to be received from a satellite, which narrows the field of view for receiving by the antenna and degrades the receiving characteristic. The satellite radio receiving antenna must have wide directivity, but when the antenna is provided in a vehicle, the roof does not serve as a ground plate, and therefore sufficient directivity is not provided.

SUMMARY OF THE INVENTION

The present invention has been made in view of the above described circumstances associated with the conventional technique, and it is an object of the invention to provide a satellite radio receiving antenna that can suitably be provided in a vehicle and a satellite radio receiving system using such a satellite radio receiving antenna.

An antenna device according to the invention receives a radio wave in an internal space formed by a pair of case parts and has a receiving module. The receiving module includes a dielectric substrate, an antenna element provided on one main surface of the dielectric substrate, a ground plate provided on the other main surface of the dielectric substrate, a circuit board provided at the backside of the main surface of the ground plate having the dielectric substrate, and a shield case that shields the circuit board. The ground plate has an extension that extends parallel to the antenna element from the outer peripheries of the dielectric substrate and the circuit board. The extension is supported inside the pair of case parts, so that the receiving module is fixed in the internal space of the pair of case parts.

A radio wave receiving system includes a plurality of such antenna devices, each of which is attached on the inner surface of a windowpane in a vehicle, and a signal received by each of the antenna devices is processed by a diversity method.

In the antenna device according to the invention, the receiving module is supported and fixed by the ground plate in the internal space formed by the pair of case parts, and therefore an additional member for supporting and fixing is not necessary. Therefore, the structure can be simplified and the cost can be reduced. The area of the ground plate can be as large as possible in the internal space formed by the pair of case parts, so that the receiving characteristic can be improved.

In the radio wave receiving system according to the invention as described above, the antenna device is attached to the inner surface of a windowpane in an automobile. Therefore, the effect of metal members such as the roof and pillars of the automobile on the receiving sensitivity can be minimized, so that good receiving characteristic can be achieved. Since signals are received by a diversity method using a plurality of satellite radio receiving antennas, a poor receiving environment can be compensated for and signals from a satellite can be received surely and continuously.

In the antenna device according to the invention, the receiving module is supported and fixed by the ground plate in the internal space formed by the pair of case parts, and therefore an additional member for supporting and fixing is not necessary. Therefore, the structure can be simplified and the cost can be reduced. The area of the ground plate can be as large as possible in the internal space formed by the pair of case parts, so that the receiving characteristic can be improved.

In the radio wave receiving system according to the invention as described above, the antenna device is attached to the inner surface of a windowpane in an automobile. Therefore, the effect of metal members such as the roof and pillars of the automobile on the receiving sensitivity can be minimized, so that good receiving characteristic can be achieved. Since signals are received and processed by a diversity method using a plurality of satellite radio receiving antennas, a poor receiving environment can be compensated for and signals from a satellite can be received surely and continuously.

Therefore, according to the invention, a satellite radio receiving system that can readily be attached to a vehicle can be provided with low cost. Furthermore, the receiving antenna is provided in the vehicle, and therefore the appearance of the vehicle is not affected.

DETAILED DESCRIPTION OF THE PREFERRED EMBODIMENTS

Now, an embodiment of the invention will be described in detail in conjunction with the accompanying drawings. In the following, a satellite radio receiving antenna 10 (hereinafter simply as "receiving antenna 10") as shown in FIGS. 1 and 2 will be described as an application of the invention.

In this embodiment, the receiving antenna 10 receives satellite radio signals transmitted in satellite broadcasting in the range from 2.32 GHz to 2.34 GHz.

Figure 1:
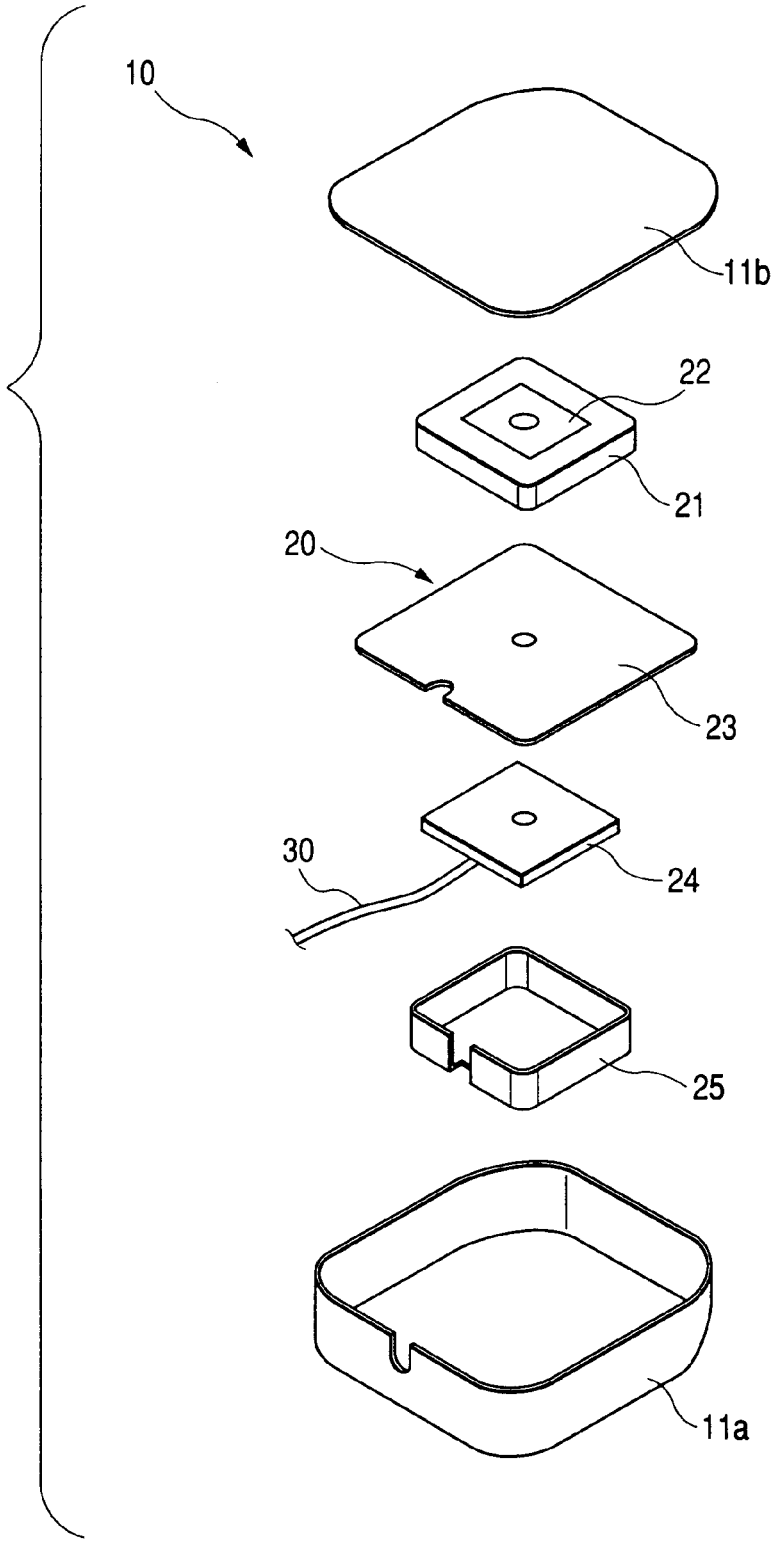
FIG. 1 is a schematic, exploded perspective view of a satellite radio receiving antenna to which the invention is applied.
Figure 2:
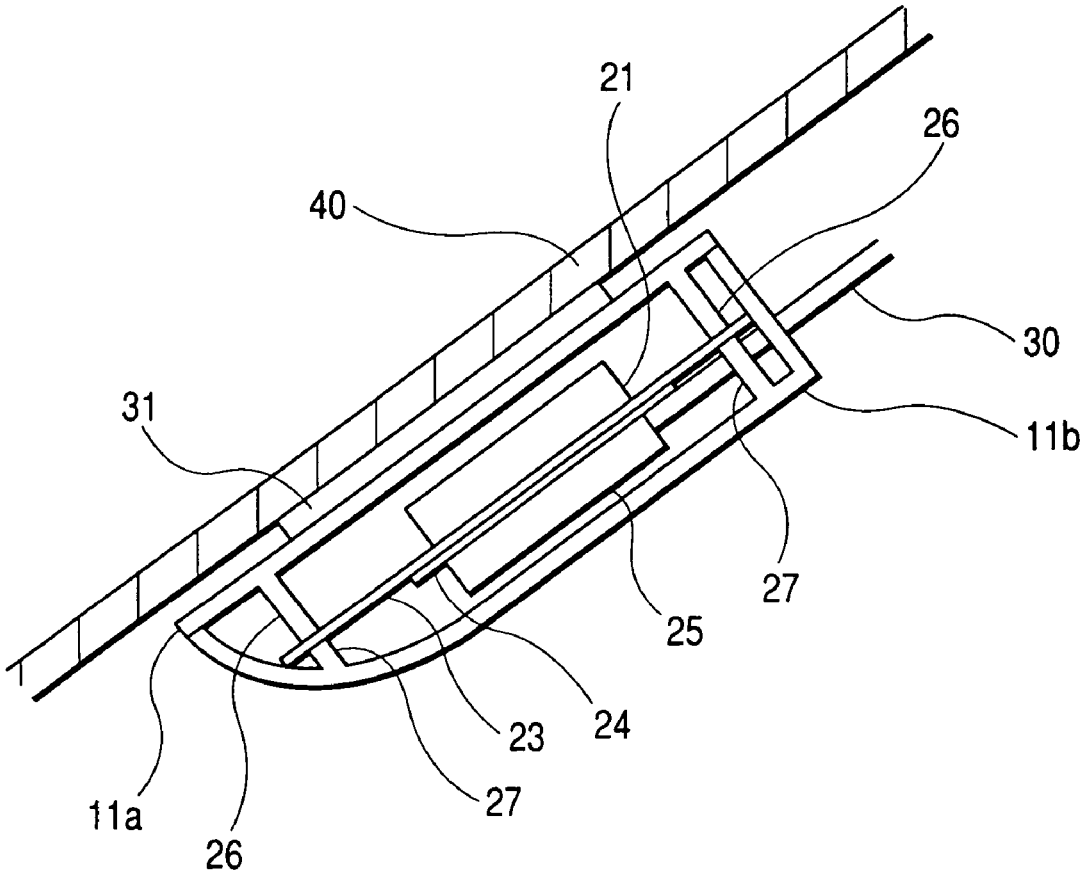
FIG. 2 is a sectional side view showing an example of how the satellite radio receiving antenna according to the invention is provided in an automobile.

As shown in FIGS. 1 and 2, the receiving antenna 10 has a case main body formed by joining a pair of case parts 11*a* and 11*b* made for example of a resin material. In this embodiment, the case part 11*a* is in a bowl shape, and the other part 11*b* is in a plate shape. The case part 11*b* has a plan view shape corresponding to an opening formed at the bottom of the case part 11*a*, and the pair of the case parts 11*a* and 11*b* are made into an integral form as a projection 26 is fitted with a receiving part 27, so that the main body case 11 is formed. Note that while the main body case 11 may have an arbitrary outer size, the size is 100 mm×80 mm×100 mm in this embodiment.

A receiving module 20 is stored in the internal space of the main body case 11. The receiving module 20 includes a dielectric substrate 21 made of a dielectric material and having a plate shape with a prescribed thickness, an antenna element 22 provided on one main surface of the dielectric substrate 21, a ground plate 23 provided on the other main surface of the dielectric substrate 21, a circuit board 24 provided at the backside of the main surface having the dielectric substrate 21 at the ground plate 23, and a shield case 25 that shields the circuit board 24.

The antenna element 22 is made of a conductive material such as a metal and has a plate shape with a prescribed outer size. In the example, the antenna element 22 is fitted on the main surface side of the dielectric substrate 21, and the dielectric substrate 21 is flush with the antenna element 22.

The ground plate 23 made of a conductive material such as a metal extends parallel to the antenna element 22 beyond the outer peripheries of the dielectric substrate 21 and the circuit board 24. In this embodiment, the extended part of the ground plate 23 is referred to as extension 23*a*.

The dielectric substrate 21 has a pin hole (not shown) through the dielectric substrate 21 immediately below the position of the antenna element 22. A pin (not shown) that electrically connects the antenna element 22 and the ground plate 23 is inserted through the pin hole.

In the receiving antenna 10, the antenna element 22, the dielectric substrate 21, and the ground plate 23 have the above structure and these elements form a planar antenna (patch antenna).

The circuit board 24 has an amplification circuit or the like that amplifies signals from the satellite received by the planar antenna including the antenna element 22, the dielectric substrate 21, and the ground plate 23. The circuit includes various electronic elements and a semiconductor chip. The circuit board 24 is connected with a signal line 30. The signal line 30 is extended externally from the main body case 11 through a hole for signal line extension formed at the case part 11*a*.

The receiving module 20 described above has the extension 23*a* of the ground plate 23 supported between the projection 26 and the receiving part 27 of the pair of the case parts 11*a* and 11*b*, so that the receiving module is fixed in the internal space of the main body case 11. The module is adhered to a windowpane 40 for example with an adhesive sheet 31 and thus provided in the vehicle.

In the receiving antenna 10, the receiving module 20 is fixed and supported as the extension 23*a* of the ground plate 23 is fixed while the projection 26 and the receiving part 27 of the main body case 11 are fitted. Therefore, an additional member for fixing and supporting is not necessary. Therefore, the structure can be simplified and the cost can be reduced. The area of the ground plate 23 can be as large as possible in the internal space of the main body case 11, so that the receiving characteristic can be improved.

The above described receiving antenna 10 is provided in a vehicle such as an automobile as follows in order to receive radio broadcasting signals transmitted from a satellite.

More specifically, for example two receiving antennas 10 are prepared, one of which is attached to the inner side (on the vehicle interior side) of the front windowpane of the vehicle. At the time, the receiving antenna 10 is provided as the bottom surface of the case part 11*b* is attached to the windowpane through an adhesive sheet 31 or the like. The other receiving antenna 10 is attached to the rear windowpane of the vehicle on the inner side. Then, signals received by the two receiving antennas 10 provided as described above are processed by a diversity method using a receiver (not shown).

In the satellite radio receiving system as described above, a number of such receiving antennas 10 are prepared and attached to the inner side of windowpanes in the vehicle. Therefore, the effect of metal members such as the roof and pillars of the automobile upon the receiving sensitivity can be minimized. The signals are received by the diversity method using the plurality of receiving antennas 10, so that a poor receiving environment can be compensated for, and signals from the satellite can be received surely and continuously.

The receiving antenna 10 is thus provided in the vehicle, and therefore the appearance of the vehicle is not affected as much as the case of providing the antenna for receiving radio broadcasting on the exterior of the vehicle. In addition, the complicated operation of extending the signal line into the interior of the vehicle from the exterior can be eliminated, so that the receiving antenna can be provided extremely easily.

The receiving antennas 10 may also be provided on the right and left windowpanes in the same manner. Signals may be received by a diversity method using the four antennas 10 in total. In this way, better receiving characteristic can surely be secured than the case of using two receiving antennas 10.

What is claimed is:

1. An antenna device, comprising:

an antenna module, receiving a radio wave and comprising:

a ground plate, extending in a first direction;

a substrate, comprising an antenna element extending in the first direction and mounted on the ground plate; and a circuit board, mounted on the ground plate;

an upper case and a lower case coupled with each other to define an internal space for accommodating the antenna module such that the ground plate is pinched by a first projection extended from an inner surface of the upper case and a second projection extended from an inner surface of the lower case.

2. The antenna device according to claim 1, wherein the substrate is comprised of a dielectric material.

3. The antenna device according to claim 1, wherein the ground plate is comprised of a conductive material.

4. The antenna device according to claim 1, wherein the antenna module comprises a pin, electrically connecting the antenna element and the ground plate, which is inserted into a hole formed in the substrate.

5. The antenna device according to claim 1, wherein said ground plane extends in a direction parallel to said antenna element and beyond outer peripheries of said substrate and said circuit board.

6. The antenna device according to claim 1, wherein the antenna module is further comprised of a shield case that shields said circuit board.

7. A radio wave receiving system, comprising a plurality of antenna devices, said antenna devices each comprising:

an antenna module, receiving a radio wave and comprising:

a ground plate, extending in a first direction;

a substrate, comprising an antenna element extending in the first direction and mounted on the ground plate; and a circuit board, mounted on the ground plate;

an upper case and a lower case coupled with each other to define an internal space for accommodating the antenna module such that the ground plate is pinched by the upper case and the lower case, wherein each of the plurality of antenna devices is attached on an inner surface of a windowpane of a vehicle.

8. The radio wave receiving system according to claim 7, wherein the radio received by each of the antenna devices is processed by a diversity method.

9. The radio wave receiving system according to claim 8, wherein the plural antenna devices includes:

a first antenna device, attached to an inner surface of a front windowpane; and a second device, attached to an inner surface of a rear windowpane.

* * * * *